US005335791A

United States Patent [19]

Eason

[11] Patent Number: 5,335,791

[45] Date of Patent: Aug. 9, 1994

[54] BACKLIGHT SORTING SYSTEM AND METHOD

[75] Inventor: Neal P. Eason, Central Point, Oreg.

[73] Assignee: Simco/Ramic Corporation, Medford, Oreg.

[21] Appl. No.: 105,438

[22] Filed: Aug. 12, 1993

[51] Int. Cl.[5] ..... B07C 5/00

[52] U.S. Cl. ..... 209/588; 209/938; 209/939

[58] Field of Search ..... 209/576, 577, 588, 939, 209/938; 198/495–497

[56] References Cited

U.S. PATENT DOCUMENTS

| | | | |
|---|---|---|---|
| Re. 33,357 | 9/1990 | Randall | 358/106 |
| 1,302,466 | 4/1919 | Finster et al. | 209/938 |
| 3,721,501 | 3/1973 | Atkinson et al. | 356/201 |
| 3,773,172 | 11/1973 | McClure et al. | 209/588 X |
| 3,802,558 | 4/1974 | Rhys | 209/75 |
| 3,890,221 | 6/1975 | Muehlethaler | 209/111.7 |
| 4,280,625 | 7/1981 | Grobbelaar et al. | 209/582 |
| 4,706,336 | 11/1987 | Hartmann et al. | 209/938 X |
| 4,805,778 | 2/1989 | Nambu | 209/938 X |
| 5,013,906 | 5/1991 | Miyakawa et al. | 209/588 X |
| 5,085,325 | 2/1992 | Jones et al. | 209/580 |
| 5,115,987 | 5/1992 | Mithal | 241/23 |
| 5,141,110 | 8/1992 | Trischan et al. | 209/524 |
| 5,150,307 | 9/1992 | McCourt et al. | 364/478 |
| 5,260,576 | 11/1993 | Sommer, Jr. et al. | 209/577 X |

*Primary Examiner*—D. Glenn Dayoan
*Attorney, Agent, or Firm*—Stoel Rives Boley Jones & Grey

[57] ABSTRACT

A sorting apparatus according to the present invention includes a conveyor belt having a solid translucent sheet segment for carrying a stream randomly-arranged articles, ones of which are translucent and others of which are opaque. Preferably, the translucent articles are pieces of post-consumer plastic products (e.g., beverage containers) and the opaque articles are foreign matter, such as aluminum or polypropylene container tops or caps of the beverage containers. The conveyor belt carries multiple articles simultaneously through an inspection zone. A background light source is positioned in the inspection zone opposite the translucent sheet segment from the articles to direct light through the translucent sheet segment toward the articles. A video camera is positioned to receive light from the background light source transmitted through the translucent sheet segment and translucent ones of the articles. The opaque ones of the articles prevent light from the background light source from reaching the video camera. The video camera generates a video signal from which a system processor identifies the opaque articles and activates a separator to remove the opaque articles from the stream of articles.

20 Claims, 2 Drawing Sheets

BACKLIGHT SORTING SYSTEM AND METHOD

TECHNICAL FIELD

This invention relates to sorting systems and, in particular, to an apparatus and a method for sorting materials according to light transmittance characteristics, such as sorting opaque foreign material from translucent post-consumer plastic articles.

BACKGROUND OF THE INVENTION

Growing environmental awareness has developed a market need for recycling plastic articles. Such articles are made from nonrenewable petrochemical resources, consume diminishing landfill space, and decompose very slowly. The market for recycled plastic is cost-sensitive, and removing contaminants from post-consumer plastics is a major cost of processing them. Accordingly, high-speed, automated sorting systems are needed to sort foreign materials from post-consumer plastic articles.

Many post-consumer plastic articles are containers, such as beverage containers, that are of a single plastic (e.g., polyethylene terephthalate, referred to as PET) and are originally sold with an associated top or cap of a different material (e.g., aluminum or polypropylene). Consumers frequently return such containers for recycling with the top or cap still attached, thereby introducing undesirable contamination into and greatly diminishing the value of the recycled plastic.

Typically, recycling of post-consumer plastic articles includes shredding or flaking the items before subsequent processing. A conventional automated sorting system can have difficulty distinguishing certain common foreign materials from the desired plastic flakes.

More specifically, many conventional sorting systems include a white conveyor belt for carrying articles to be inspected (e.g., the flaked plastic articles) past a video camera that generates a video signal representing the articles on the conveyor belt. With many post-consumer plastic containers being of clear or translucent plastic and the contaminating polypropylene or aluminum caps being white, the sorting system is incapable of distinguishing undesirable white caps from the apparently white color of translucent plastic flakes on the white conveyor belt. As a consequence, it has been difficult to achieve high-throughput, automated sorting of foreign materials from flaked translucent post-consumer plastic articles.

Other sorting systems are directed to sorting whole plastic containers, typically one at a time. These systems either drop each whole container through an inspection zone or carry each whole container on top of a conveyor belt so the container extends between a light source and camera positioned over the conveyor belt. Both types of system suffer from relatively low throughput and are incapable of removing from the recycled articles attached foreign objects, such as caps or tops that are attached to containers.

SUMMARY OF THE INVENTION

An object of the present invention is, therefore, to provide an apparatus and a method for sorting opaque foreign material from translucent articles.

Another object of this invention is to provide such an apparatus and a method for sorting opaque foreign material from post-consumer translucent plastics.

A further object of this invention is to provide such an apparatus and a method for sorting articles at a high throughput.

A sorting apparatus according to the present invention includes a conveyor belt having a solid translucent sheet segment for carrying a stream randomly-arranged articles, ones of which are translucent and others of which are opaque. Preferably, the translucent articles are pieces of post-consumer plastic products (e.g., beverage containers) and the opaque articles are foreign matter that includes aluminum or polypropylene beverage container tops or caps.

The conveyor belt carries multiple articles simultaneously through an inspection zone. Preferably, a background light source is positioned in the inspection zone opposite the translucent sheet segment from the articles to direct light through the translucent sheet segment toward the articles. A video camera is positioned to receive light from the background light source transmitted through the translucent sheet segment and translucent ones of the articles. The opaque ones of the articles prevent light from the background light source from reaching the video camera.

The video camera generates a video signal representative of the light it receives. A controller receives the video signal and processes it to identify the opaque ones of the articles. In coordination with the movement of the conveyor belt and the location of the opaque articles thereon, the controller activates a separator to separate the opaque articles from the translucent ones. Accordingly, the sorting system of the present invention is capable of providing high throughput, accurate sorting of opaque foreign material from post-consumer translucent plastics.

Additional objects and advantages of this invention will be apparent from the following detailed description of a preferred embodiment thereof which proceeds with reference to the accompanying drawings.

DETAILED DESCRIPTION OF PREFERRED EMBODIMENTS

Figure 1:
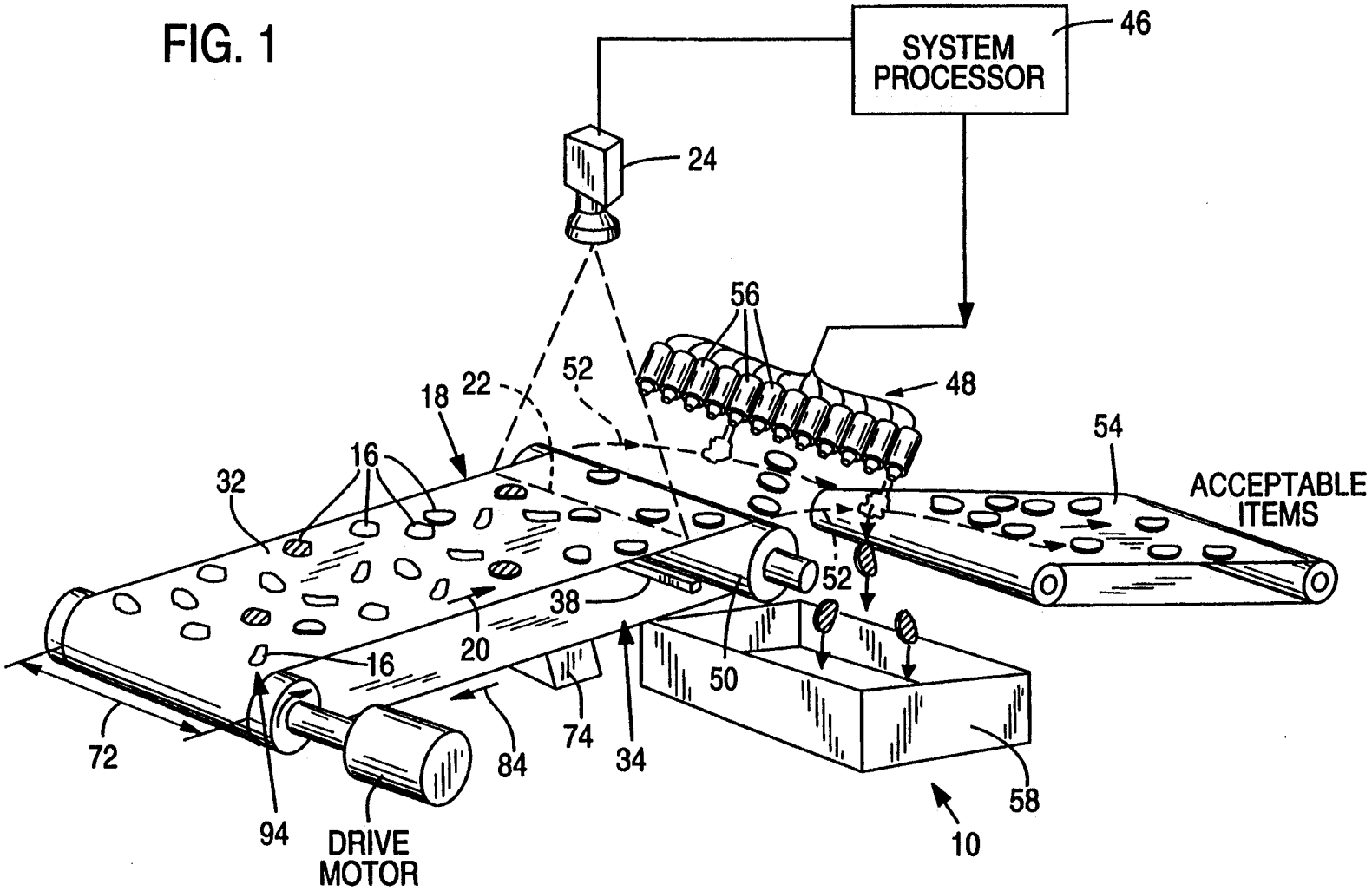
FIG. 1 is a combined diagrammatic side elevation and block diagram of a sorting system of the present invention.
Figure 2:
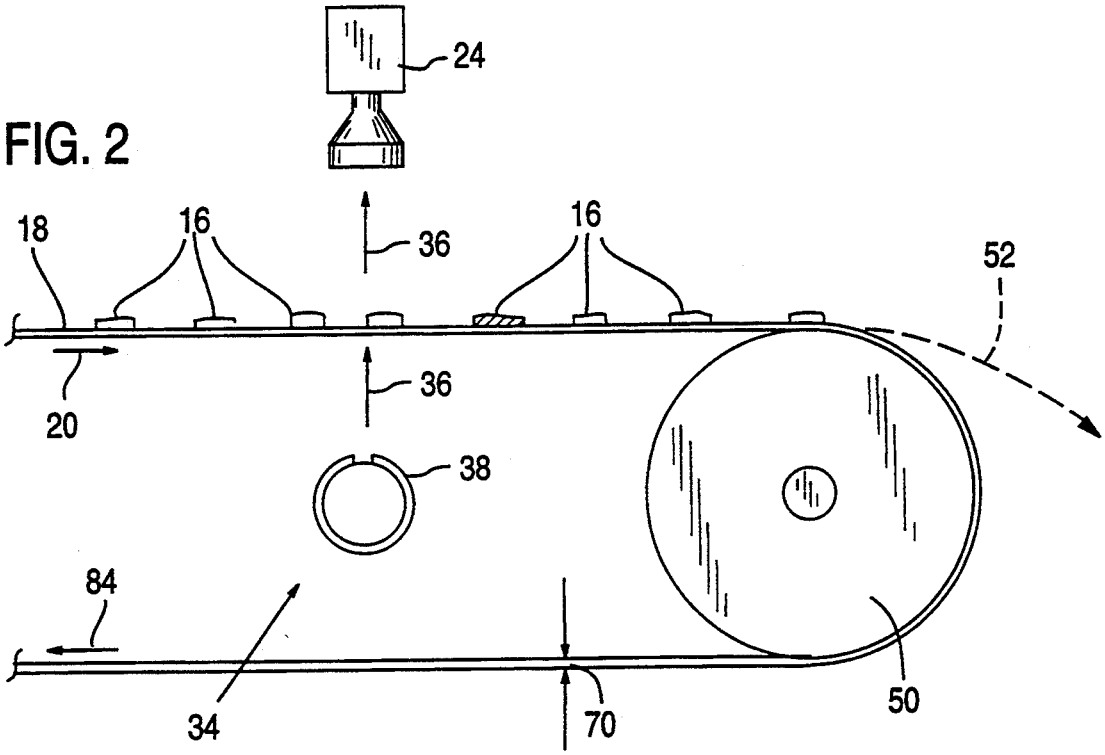
FIG. 2 is a diagrammatic side view showing the inspection zone of the sorting system of FIG. 1.

Referring to FIGS. 1 and 2, a sorting system 10 of the present invention sorts articles 16 randomly scattered on a conveyor belt 18 that moves in a direction 20 through an inspection zone 22. Belt 18 carries multiple articles 16 at a time through inspection zone 22, which is defined by a field of view of a line scanning CCD array video camera 24. Ones of articles 16 are translucent and others are opaque, the latter of which are designated by hatching. Preferably, the translucent articles 16 are pieces of post-consumer plastic products (e.g., beverage containers) and the opaque articles are foreign matter, such as aluminum or polypropylene container tops or caps for the beverage containers.

Conveyor belt 18 includes a solid translucent sheet segment 32 for carrying articles 16. A background light source 34 is positioned in inspection zone 22 opposite translucent sheet segment 32 from articles 16 to direct light 36 through translucent sheet segment 32 toward the articles 16. Background light source 34 includes a very-high-output ("VHO"), apertured, fluorescent lamp 38 focused on inspection zone 22 by a reflective coating (not shown) covering all of lamp 38 except a narrow, elongated aperture in the reflective coating facing inspection zone 22. An exemplary fluorescent lamp 38 is manufactured by Interelectric of Warren, Pa.

Video camera 24 is positioned to receive light 36 from background light source 34 transmitted through translucent sheet segment 32 and translucent ones of the articles 16. Opaque ones of articles 16 prevent light 36 from background light source 34 from reaching video camera 24, thereby allowing it to distinguish the opaque and translucent articles 16.

Video camera 24 generates a video signal representing the light it receives. A system processor 46 receives the video signal and processes it to identify the opaque ones of articles 16. In coordination with the movement of conveyor belt 18, processor 46 activates a separator 48 to separate the opaque articles 16 from the translucent ones. Preferably, conveyor belt 18 carries all articles 16 past inspection zone 22 to an outfeed bar or roller 50 from which articles 16 are projected along a trajectory 52 toward an acceptance conveyor belt 54. Whenever controller 46 determines that an article 16 is not opaque, the article 16 passes to acceptance conveyor belt 54 for further processing. Whenever it determines that an article 16 is opaque, processor 46 generates an activation signal to activate at least one of multiple fluid ejector modules 56 in separator 48. In response to the activation signal, an ejector module 56 releases a blast of air that deflects the opaque article 16 from trajectory 52 toward a reject zone 58.

It will be appreciated by persons skilled in the art that many conventional implementations are available for video camera 24, processor 46, and separator 48. For example, video camera 24 may detect color (e.g., RGB) or monochrome characteristics of articles 16, and processor 46 may process the video signal with analog or digital circuitry. Preferably, video camera 24 detects monochrome characteristics of articles 16, and processor 46 processes the video signal with digital circuitry. U.S. Pat. No. 5,085,325 of Jones etal., assigned to the assignee of the present invention and hereby incorporated by reference, describes a color sorting system that could be simplified for operation with a monochrome video camera for use in sorting system 10.

In a preferred embodiment, video camera 24 is of the monochrome CCD array line-scan type that is fitted with a lens and aperture suitable for the application and resolution. Fluorescent lamp 38 is of a length matched to that of inspection zone 22 and is driven by an optically regulated power supply such as Mercron Ballast Model HR FXC 2372.

Conveyor belt 18 is preferably formed of clear, 2-ply, anti-static polyurethane as available from Globe International of St. Louis, Mo., with a thickness 70 of 0.068 inch (1.7 mm) and a width 72 of 51⅜ inches (130 cm). As an example, desireable translucent articles 16 transmit more than 60 percent of visible light, and undesirable opaque articles transmit less than about 50 percent of visible light. Controller 46 distinguishes translucent and opaque articles 16 accordingly.

However, different transmittance threshold values are selectable for distinguishing different translucent and opaque articles. For example, sorting aluminum from clear and green-tinted PET could employ a relatively low transmittance threshold between opaque (i.e., aluminum) and translucent (i.e., PET). In contrast, sorting green-tinted PET from clear PET would employ a relatively high transmittance threshold between opaque (i.e., green-tinted PET) and translucent (i.e., clear PET).

Conveyor belt 18 is driven in direction 20 at a speed of between 300 ft/min (91 m/min) and 1200 ft/min (275m/min). Exposure time for each camera scan is 0.5 to 1.0 milliseconds. Accordingly, when sorting pieces of post-consumer plastic products, sorting system 10 has a throughput of up to about 7,500 pounds/hour (3400 kg/hour).

Sorting system 10 may be used to sort either generally dry or generally wet articles 16. In both cases, continuous cleaning of conveyor belt 18 maintains its translucence and thereby an easily distinguishable difference in transmissivity of translucent and opaque articles 16. Accordingly, a cleaning unit 74 is positioned in engagement with, to continuously clean, conveyor belt 18 after it passes over outfeed bar or end roller 50.

Figure 3A:
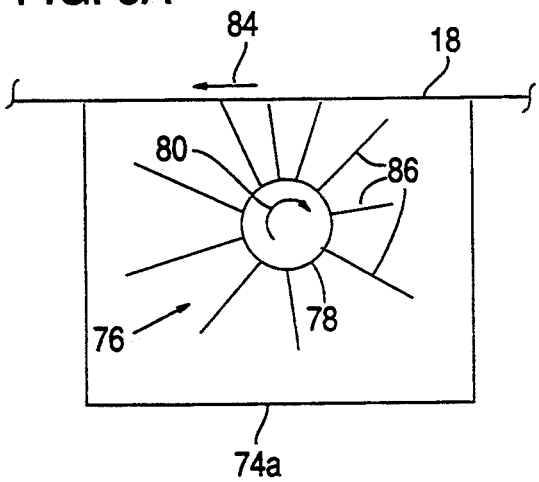
FIGS. 3A and 3B are diagrammatic side views of alternative belt-cleaning elements employed in the sorting system of FIG. 1.

FIG. 3A shows a cleaning unit 74*a* for use when sorting system 10 is directed to sorting generally dry articles 16, such as sorting dry polypropylene and aluminum from green and clear PET. Cleaning unit 74*a* includes a cylindrical brush 76 that extends across conveyor belt 18 and rotates about a spindle 78 in a rotational direction 80, thereby to brush belt 18 in a direction opposite direction 84 of belt return motion. Cylindrical brush 76 includes bristles 86 of a relatively soft material, such as nylon, to avoid scratching or otherwise damaging the surface of conveyor belt 18.

Figure 3B:
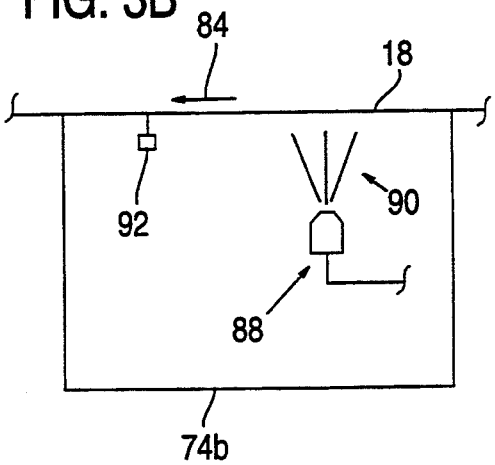

FIG. 3B shows a cleaning unit 74*b* for use when sorting system 10 is directed to sorting generally wet articles 16, such as sorting wet polypropylene and aluminum from green and clear PET. Cleaning unit 74*b* includes a water sprayer 88 that sprays water 90 onto belt 18 and a subsequent elastomer wiper 92 that removes the water and any residue of the generally wet articles 16. Many appropriate mounting, driving, and debris collection or removal structures for cleaning units 74*a* and 74*b* could be implemented by persons skilled in the art.

Sorting system 10 preferably receives and sorts translucent articles that include pieces of post-consumer plastic products (e.g., polyethylene terephthalate, referred to as PET, containers) and opaque articles that are foreign matter and include, either whole or in pieces, aluminum or polypropylene container tops or caps for the containers. The post-consumer plastic products are preferably formed into pieces or flakes by a granulator, as is known in the art, before being delivered to conveyor belt 18 at an infeed region 94.

Sorting system 10 is capable of providing high-speed sorting of a variety of translucent and relatively opaque materials. For example, sorting system 10 could also sort colored (e.g., green) translucent PET flakes from clear PET flakes, or opaque pieces of high density polyethylene (HDPE) beverage container tops from pieces of translucent natural high density polyethylene (NHDPE) beverage containers. Moreover, sorting system 10 is capable of providing high-speed sorting of materials other than post-consumer plastics, such as sorting ceramic fragments from glass ones, as arise in glass cullet, and sorting certain contaminants and defectives from agricultural or food products such as rice and potato chips.

It will be obvious to those having skill in the art that many changes may be made to the details of the above-described embodiment of this invention without departing from the underlying principles thereof. The scope of the present invention should be determined, therefore, only by the following claims.

I claim:

1. A sorting system, comprising:

a conveyor belt having a solid translucent sheet segment for carrying a plurality of randomly-arranged articles, ones of which are translucent and others of which are opaque, the conveyor belt carrying plural articles simultaneously through an inspection zone;

a background light source positioned in the inspection zone to direct light through the translucent sheet segment and the translucent ones of the articles;

a video camera positioned to receive light from the background light source transmitted through the translucent sheet segment and the translucent ones of the articles, the opaque ones of the articles preventing light from the background light source from reaching the video camera, the video camera generating a video signal representing the light it receives;

a processor receiving the video signal and processing it to identify the opaque ones of the articles; and a separator responsive to the processor for separating the opaque and translucent ones of the articles.

2. The system of claim 1 in which the background light source and the video camera are positioned such that the background light source is opposite the translucent sheet segment from the articles and the video camera.

3. The system of claim 1 further comprising a cleaning station with a cleaning element in engagement with the conveyor belt for cleaning it continuously while articles are sorted.

4. The system of claim 3 in which the cleaning element includes a rotating brush.

5. The system of claim 3 in which the cleaning element includes a water sprayer and a wiper.

6. The system of claim 1 in which the translucent ones of the articles include pieces of post-consumer translucent plastic products.

7. The system of claim 1 in which the postconsumer translucent plastic products are formed of PET or NHDPE.

8. In a sorting system having a video camera positioned to receive light transmitted through translucent ones of plural articles, other ones of the articles being opaque, the video camera generating a video signal representative of the light it receives, a processor receiving the video signal and processing it to identify the opaque ones of the articles and a separator responsive to the processor separating the opaque and translucent ones of the articles, the improvement comprising:

a conveyor belt having a solid translucent sheet segment for carrying the plural articles simultaneously through an inspection zone; and a background light source positioned in the inspection zone to direct light through the translucent sheet segment and the translucent ones of the articles toward the video camera, the opaque ones of the articles preventing light from the background light source from reaching the video camera and thereby being distinguishable from the transparent ones of the articles.

9. The system of claim 8 in which the background light source and the video camera are positioned such that the background light source is opposite the translucent sheet segment from the articles and the video camera.

10. The system of claim 8 further comprising a cleaning station with a cleaning element in engagement with the conveyor belt for cleaning it continuously while articles are sorted.

11. The system of claim 10 in which the cleaning element includes a rotating brush.

12. The system of claim 10 in which the cleaning element includes a water sprayer and a wiper.

13. A method of sorting opaque foreign objects from a stream of post-consumer translucent plastic articles, comprising the steps of:

transporting the stream of post-consumer translucent plastic articles and opaque foreign objects on a solid, translucent conveyor belt through an inspection zone;

directing light through the conveyor belt and the translucent ones of the post-consumer translucent plastic articles toward a video camera;

generating a signal representative of the light propagating through the belt to the video camera, the signal representing an opaque foreign article by a signal corresponding to the absence of light arriving at the video camera; and in accordance with a signal corresponding to the absence of light, removing the opaque foreign article from the stream of post-consumer translucent plastic articles.

14. The method of claim 13 in which the light is directed through the conveyor belt from a side opposite that on which the articles are carried.

15. The method of claim 13 further comprising the step of continuously cleaning the conveyor belt while it transports the stream of articles.

16. The method of claim 13 in which postconsumer translucent plastic articles include pieces of post-consumer translucent plastic products.

17. The method of claim 16 in which the postconsumer translucent plastic products comprise PET.

18. A method of sorting opaque foreign objects from a stream of translucent articles, comprising the steps of:

transporting a stream of randomly-arranged articles simultaneously through an inspection zone, ones of which articles are translucent and others of which are opaque;

directing light through stream of articles toward a video camera;

generating a signal representative of the light propagating through the stream of articles to the video camera, the signal representing an opaque foreign article by a signal corresponding to the absence of light arriving at the video camera; and in accordance with a signal corresponding to the absence of light, separating the opaque and translucent ones of the articles.

19. The method of claim 18 in which the step of transporting the stream of randomly-arranged articles simultaneously through an inspection zone includes carrying the articles on a solid, translucent conveyor belt through the inspection zone.

20. The method of claim 18 in which the translucent ones of the articles include pieces of post-consumer translucent plastic products.

* * * * *